US005212499A

United States Patent [19]

Hongo et al.

[11] Patent Number: 5,212,499

[45] Date of Patent: May 18, 1993

[54] PRESSING MECHANISM FOR THERMAL PRINTER

[75] Inventors: Takayasu Hongo; Yoshinobu Masumura, both of Amagasaki, Japan

[73] Assignee: Kanzaki Paper Mfg. Co., Ltd., Tokyo, Japan

[21] Appl. No.: 858,992

[22] Filed: Mar. 27, 1992

[30] Foreign Application Priority Data

Mar. 29, 1991 [JP] Japan ..... 3-065885

[51] Int. Cl.[5] ..... B41J 11/14; B41J 2/325

[52] U.S. Cl. ..... 346/76 PH; 400/648; 400/649; 400/653

[58] Field of Search ..... 400/648, 649, 653; 346/76 PH

[56] References Cited

U.S. PATENT DOCUMENTS 4,844,631 7/1989 Feron et al. ..... 346/76 PH
5,063,395 11/1991 Muita et al. ..... 346/76 PH

FOREIGN PATENT DOCUMENTS 0102789 6/1983 Japan ..... 400/649
0192587 10/1984 Japan ..... 400/232

*Primary Examiner*—Benjamin R. Fuller
*Assistant Examiner*—Huan Tran
*Attorney, Agent, or Firm*—Cushman, Darby & Cushman

[57] ABSTRACT

A thermal printer of the present invention includes a platen for pressing a thermal head onto a print sheet through a print ribbon at the time of printing, the head is fixed, and a device for resiliently pressing the platen and the head and a device for switching the operation of applying or releasing a pressure between the platen and the head are provided on the platen side.

7 Claims, 2 Drawing Sheets

PRESSING MECHANISM FOR THERMAL PRINTER

BACKGROUND OF THE INVENTION

The invention relates to a thermal printer, and more particularly to a pressing mechanism between a print head and a platen.

A conventional printer that pressed and retracted its platen includes a unitized mechanism consisting of a motor, an eccentric cam valid for both pressing and releasing directions and an arm. It has a pressuring spring on a thermal head side to press the platen onto a thermal head so that a nip pressure is applied. This system has addressed, e.g., the following problems.

a) When the platen is pressed or retracted, vibrations of the thermal head are caused due to a pressing spring disposed on the thermal head side. As a result, a condition of a printing press section is changed. Specifically, when the ribbon dispenser is used for printing, a sheet having a ribbon thereon travels through a path from the printing press section to the ribbon dispenser. At this time, the path is changed by vibrating the thermal head described above to change a position at which the ribbon separated. Therefore, it is difficult to obtain a satisfactory print quality in stable manner, and a folded portion of the ribbon is undesirably caused. Additionally, the vibrations of thermal head are also generated by adjusting a nip pressure when the thickness or type of sheet is changed.

b) When the head is replaced by a new one, replacing work is difficult owing to the spring pressure applied to the head.

SUMMARY OF THE INVENTION

The invention relates to the a thermal printer which is capable not only of eliminating variations in the conditions of the pressing section, in particular, variations in the path between the sheet and the ribbon, but also of stably ensuring a satisfactory print quality.

The invention is applied to a thermal printer having a platen for pressing an ink ribbon and a print sheet onto a print head at the time of printing, in which the head is fixed; a ribbon dispenser is arranged behind the head so as to be in a fixed relation with respect to the head; and a means for resiliently pressing the platen toward the head and a means for switching the operation of applying or releasing a pressing force are disposed on the platen side.

Further, the present invention is applied to a thermal printer in which the resiliently pressing means and the switching means comprise a drive means comprising an eccentric cam mechanism and a resilient means comprising a spring; and further, the resiliently pressing means for resiliently pressing the platen shaft toward the head and the cam mechanism as switching means for switching the operation of applying or releasing this pressing force are contained within a same arm. Still further, the cam mechanism is arranged so as to directly act non resiliently on the platen only in a platen releasing direction when the platen is retracted.

In the present invention, the head does move not when the platen is pressed/retracted and when the nip pressure is adjusted. Therefore, conditions of the pressing section, particularly, the positional relationship among the head, the dispenser, and the ink ribbon are maintained constant, thereby it never results in undesirable problems, e.g., misaligned prints due to change in such condition and the foil portion of the ribbon. Thus, the consistency in the print quality can be improved. In addition, head replacement can be carried out quickly and easily since the spring is not attached to the head.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DETAILED DESCRIPTION OF THE PREFERRED EMBODIMENTS

Figure 1:
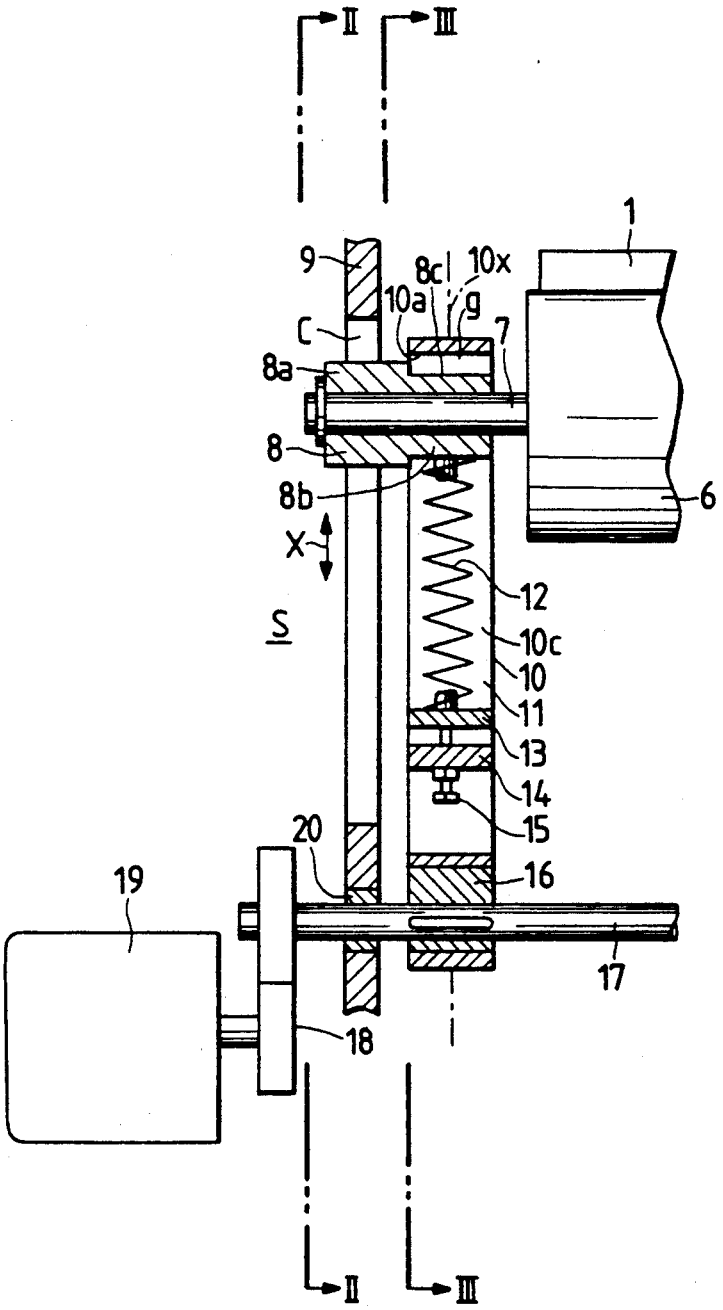
FIG. 1 is a front view showing a main portion of a thermal printer of the present invention.
Figure 2:
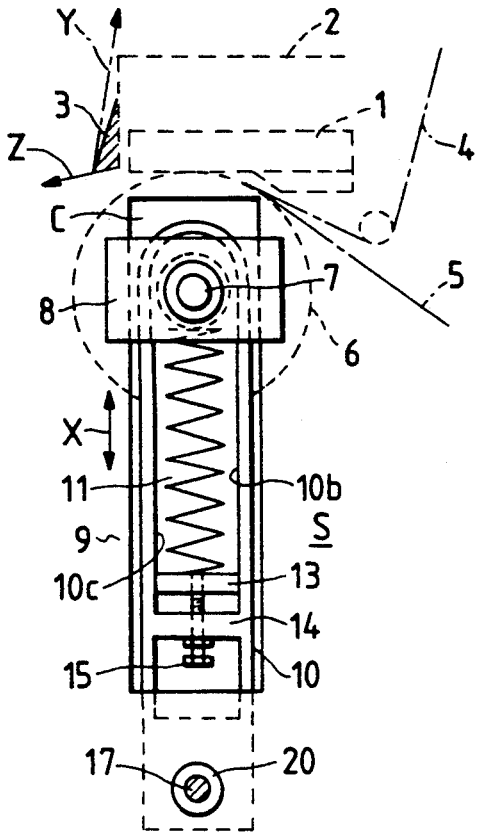
FIG. 2 is a cross sectional view taken along the line II—II of the FIG. 1.
Figure 3:
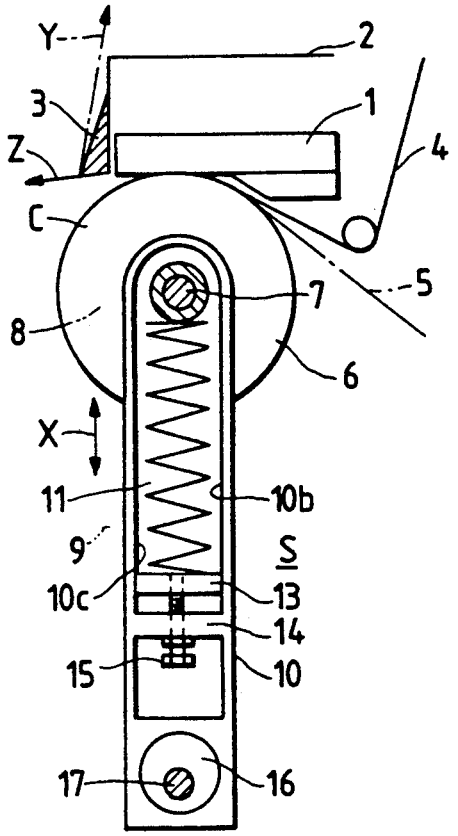
FIG. 3 is a cross sectional view taken along the line III—III of the FIG. 1.
Figure 4:
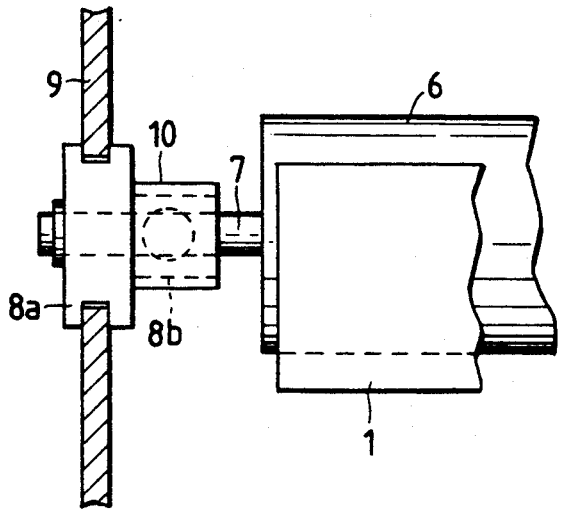
FIG. 4 is a top plan view of the main portion of the thermal printer of the present invention.

FIGS. 1, 2 and 3 are configurational diagrams showing main portions of a thermal printer, which is an embodiment of the invention. What is shown is an example in which an eccentric cam, an arm, and a pressuring spring are integrally assembled. FIG. 1 is a front view thereof, FIG. 2 is a cross sectional view taken along the line II—II of the FIG. 1, FIG. 3 is cross sectional view taken along the line III—III of the FIG. 1 and FIG. 4 is a top plan view of the main portion of the thermal printer of the present invention.

In FIGS. 1, 2, 3 and 4 reference numeral (1) designates, e.g., a heat transfer type thermal head, and reference numeral (2) designates a head cover for mounting the head (1) therein. The head (1) is mounted releasably, but the head (1) is so arranged as to be fixed when the printer is being used.

Reference numeral (3) designates a ribbon dispenser attached to the outside of the head cover (2) near a ribbon exit side of the head. The ribbon dispenser (3) is position-adjustable in a direction of confronting a printing surface of the head (1). The ribbon dispenser (3) is so arranged as not only to form a surface that is substantially continuous with the head, but also to maintain the constant positional relationship between the printing surface and itself.

Reference numeral (4) designates an ink ribbon, reference numeral (5) designates a recording sheet such as a cut sheet, reference numeral (6) designates a platen for pressing the head onto the recording sheet through the ink ribbon at the time of printing and reference numeral (7) designates a central shaft of the platen (6). As shown in the Figures, an arrow Y shows a direction in which the ink ribbon (4) is wound, and an arrow Z shows a direction to which the recording sheet (5) is transmitted.

Reference character (S) designates a platen pressing-/retracting mechanism, wherein the central shaft (7) of the platen (6) is held by a slidable metal block (8). One end (8*a*) of the metal block (8) is slidably held by a cutout (C) provided on a fixed portion of the printer, e.g., on a mechanical frame (9), and can slide back or forth in the direction of the head (as shown by an arrow X on FIGS. 1 and 2) with using the cutout (C) as a guide. As a result, the platen (6) is designed to move toward the head (1).

Reference numeral (10) designates an arm, which is, e.g., square pillar-like and transmits a driving force for pressing and releasing the platen (6). The arm (10) is positioned so that its central axis ($10_x$) intersects vertically to the central shaft (7) of the platen (6) and coincides with the head (1). (Although the direction of the central axis ($10_x$) of the arm (10) is defined by both the central shaft (7) and a cam shaft (17) to be described later, it is varied by rotation of the cam shaft (17) to some extent.)

The arm (10) has a through hole (11) which is defined by an internal wall (10*a*), internal side walls (10*b*) and (10*c*) and a lower fixed block (14), and the through hole (11) is shaped like a square pillar. The other end (8*b*) of the metal block (8) is inserted in the through hole (11) so that the other end (8*b*) can be vertically slidable in the through hole (11). A lower movable block (13) which is connected with a lower fixed block (14) via screw (15) is inserted in the through hole (11). The movable block (13) is movable in the through hole (11) by adjusting of the screw (15).

Thereby, distance between the lower movable block (13) and the lower fixed block (14) is adjusted by the screw (15), so that a distance between the lower movable block (13) and the metal block (8) is adjusted.

An end (12*a*) of a compression spring (12) is fixed on the lower movable block (13), and the other end (12*b*) of the compression spring (12) is fixed on the metal block (8). Thus, a compressing force of the compression spring (12) can be adjusted by adjusting of the screw (15). Therefore, the weight of the platen (6) and its attachments are supported by the metal block (8) through the compression spring (12).

The arm (10) has an eccentric cam (16) at a lower portion thereof in a manner that the eccentric cam (16) itself can rotate in the lower portion. The cam shaft (17) is fixedly inserted in the eccentric cam (16) so as to be rotated togetherwith. And the cam shaft (17) is supported by a bearing (20) provided on the mechanical frame (9). The cam shaft (17) is rotated by a drive motor (19) through a transmission mechanism (18) which essentially consists of many gears.

Thus, when the cam shaft (17) is at the lowest position of the eccentric cam (16) as shown in FIGS. 1, 2, 3 and 4 the top of the arm (10) is at the highest position. In contrast, when the cam shaft (17) is at the highest position of the eccentric cam (16), the top of the arm (10) is at the lowest position. The transmission mechanism has conventional photo switches or the like detecting the position of the cam shaft (17) which reaches the lowest or the highest position described above.

Accordingly, the movement of the arm is stopped in relation to the platen in a pressing or a retracting position due to the drive motor being controlled to stop the driving operation when the photo switch detects the arm reaching the lowest or highest portion.

On the other end of the platen (6) there is a mechanism (Sa) (not shown) similar to the mechanism (S) so as to be symmetrical with the structure shown in FIGS. 1, 2, 3 and 4 so that both eccentric cams synchronously be driven in common by the motor (19).

When the platen (6) begins to press toward the head (1), the cam shaft (17) comes just this side of the lowest portion of the eccentric cam (16) and the arm (10) is pushed up so that the platen (6) is elevated to bring an upper portion of the platen into contact with the head (1). When the arm is further elevated in accordance with the rotation of the eccentric cam (16), the compression spring (12) is pressed downward so that the spring force as pressing force is applied to the head (1) through the platen (6). As a result, the platen (6) is pressed to the head (1) through the recording sheet (5) and the ink ribbon (4) with an appropriate pressing force in a direction on a straight line connecting the platen shaft center with a pressure contact point between the platen (6) and the head (1) so that the pressing force (nip pressure) required for printing is applied between the head (1) and the platen (6). Such state is maintained during printing.

FIGS. 1, 2, 3 and 4 show this state. A small gap (g) is formed by compression of the compression spring (12) between the internal wall (10*a*) of the upper end of the arm (10) and the opposing the upper surface (8*c*) of the metal block. The nip pressure is adjusted by changing the maximum spring length which is adjusted by the screw (15).

The platen (6) is retracted from the head (1) as mentioned below. When the cam shaft (17) is positioned to the highest position of the eccentric cam (16), the arm (10) is moved downward and the internal wall (10*a*) comes into direct contact with the surface (8*c*) to allow the arm (10) to press directly the metal block (8) downward so that the spring force is applied to the internal wall (10*a*) through the metal block (8). As a result, the platen (6) is released from the spring force, and the platen (6) with the metal block (8) is moved downward enough to detach from the head (1). That is, the retraction of the platen (6) is effected by downward movement having a predetermined distance of the arm (10) with the metal block (8) through rotation of the eccentric cam. Namely, the pressing force applied to the head (1) through the platen (6) is released by the rotation of the eccentric cam (16).

Accordingly, a small gap can be provided between the head (1) and the platen (6), the small gap enables to allow some folded portion of the ink ribbon to be rectified or to allow the ribbon and the sheet to be moved separately when no printing operation is performed.

In this construction described above, in order to unitize components of the apparatus and make the apparatus compact, the arm (10) is formed into a pillar having a through hole, and the compression spring (12) for pressing the platen (6) and the eccentric cam (16) are contained in the arm (10). The embodiment of the present invention is not limited to the above, but it may be so designed that components such as the compression spring and the eccentric cam and the like are not contained in the arm, but are provided independently.

As outlined above, the present invention is featured by a structure wherein the pressing force is obtained by the compression spring positioned in the platen (6) side and the thermal head is fixed during printing whether the platen is pressed or retracted during printing. Namely, the thermal head is moved, only when the maintenance and replacement of the apparatus, or the replacement of the sheet or the ribbon. As a result, the following advantages can be obtained.

1) Since the positional relationship among the head, the dispenser, and the ink ribbon can be maintained constant independently of the operation of pressing an retracting the platen, the position of the head relative to the dispenser is no longer subjected to undesirable change when the platen is pressed or retracted, thereby it results in ensuring a reliable print quality.

2) Since the compression spring for bringing the platen into pressure contact with the head is disposed on the platen side not on the head side, the head can be replaced without being disturbed by the compression spring, thereby it results in easy and quick replacing operations or the like of the head.

3) Since the motor-driven eccentric cam for pressing and retracting the platen and the resiliently pressing compression spring are integrally assembled within the arm, the mechanism for pressing and retracting the platen can be designed to be compact.

Although the invention has been described in its preferred form with a certain degree of particularity, it is understood that the present invention is not limited to the disclosed embodiment, but, on the contrary, is intended to cover various modifications and equivalent arrangements without departing from the spirit and the scope of the invention as hereinafter claimed.

What is claimed is:

1. A pressing mechanism for thermal printer, comprising:

a fixed printing head;

a platen roll movably disposed adjacent said printing head;

means, operatively coupled to said platen roll, for rectilinearly moving said platen roll in a direction toward said printing head; and means for applying a pressing force to press said platen roll against said printing head, said pressing force being applied coaxially with said moving direction.

2. A pressing mechanism as claimed in claim 1, wherein said pressing force applying means includes a spring for resiliently pressing said platen roll against said printing head.

3. A pressing mechanism as claimed in claim 1, further comprising means for changing a movement direction of said platen roll so that said roll may move in a direction away from said printing head.

4. A pressing mechanism as claimed in claim 3, wherein said means for changing a movement direction includes a eccentric cam transmitting a driving force to said moving means and said pressing force applying means.

5. A pressing mechanism as claimed in claim 1, wherein said pressing force applying means is integrally formed with said moving means.

6. A pressing mechanism as claimed in claim 5, wherein said integrally formed pressing and moving means includes an arm member, said pressing force applying means being disposed within said arm member, one end of said arm member being coupled to said platen roll, another end of said arm member being operatively associated with a cam, said cam being coupled to a motor to provide the rectilinear motion to said platen roll.

7. A pressing mechanism as claimed in claim 1, wherein said moving means includes a cam and a motor, said motor being operatively coupled to said cam, said cam being operatively associated with the platen roll so as to rectilinearly move the platen roll.

* * * * *